United States Patent [19]

Sauvestre

[11] Patent Number: 4,911,079

[45] Date of Patent: Mar. 27, 1990

[54] HUNTING AMMUNITION WITH INCREASED COMBUSTION VOLUME

[76] Inventor: Jean-Claude Sauvestre, 11, rue de Veauce, 18230 Saint Doulchard, France

[21] Appl. No.: 316,089

[22] Filed: Feb. 27, 1989

Related U.S. Application Data

[63] Continuation of Ser. No. 55,901, May 29, 1987, abandoned.

[30] Foreign Application Priority Data

Jun. 5, 1986 [FR] France ..... 86 08094

[51] Int. Cl.[4] ..... F42B 5/00

[52] U.S. Cl. ..... 102/439; 102/521

[58] Field of Search ..... 102/430, 439, 434, 437, 102/376, 448, 449, 450, 451, 461, 520–523, 532

[56] References Cited

U.S. PATENT DOCUMENTS

| | | | |
|---|---|---|---|
| 3,148,472 | 9/1964 | Hegge et al. . | |
| 3,334,588 | 8/1967 | Larsen | 102/439 |
| 3,344,711 | 10/1967 | Mawhinney et al. . | |
| 3,452,677 | 7/1969 | Abela | 102/439 |
| 3,762,332 | 10/1973 | Witherspoon et al. . | |
| 3,859,922 | 1/1975 | Kaplan et al. . | |
| 3,981,246 | 9/1976 | Luther et al. | 102/521 |
| 4,249,465 | 2/1981 | Ballmann | 102/520 |
| 4,360,954 | 11/1982 | Burns et al. . | |
| 4,444,115 | 3/1984 | Romer et al. | 102/430 |
| 4,517,899 | 5/1985 | Haberli | 102/521 |
| 4,542,696 | 9/1985 | Bisping et al. | 102/430 |
| 4,651,649 | 3/1987 | Nussbaum | 102/521 |
| 4,671,182 | 6/1987 | Zierler et al. | 102/521 |

FOREIGN PATENT DOCUMENTS

| | | | |
|---|---|---|---|
| 3339078 | 5/1985 | Fed. Rep. of Germany | 102/520 |
| 1175139 | 3/1959 | France . | |
| 1282119 | 12/1961 | France . | |
| 2047780 | 3/1971 | France . | |
| 2237169 | 2/1975 | France | 102/520 |
| 2274888 | 1/1976 | France . | |
| 480605 | 2/1938 | United Kingdom . | |

*Primary Examiner*—Harold J. Tudor
*Attorney, Agent, or Firm*—Steinberg & Raskin

[57] ABSTRACT

The invention relates to hunting ammunitions each comprising a projectile actuated by the combustion of a propellant charge and characterized in that it comprises an annular chamber separated from the propellant charge by a partition comprising one or several brittle areas.

10 Claims, 3 Drawing Sheets

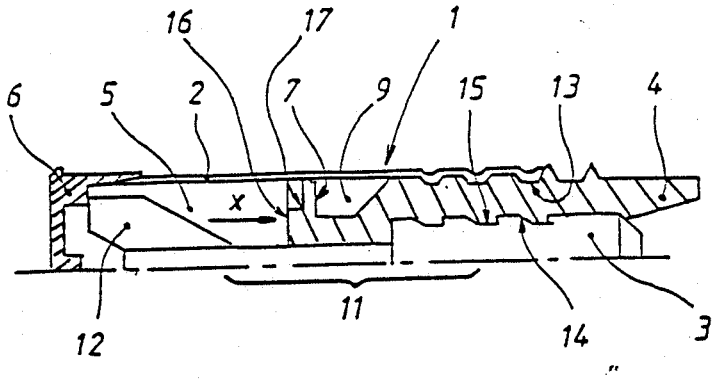
Fig 1
Fig 1A
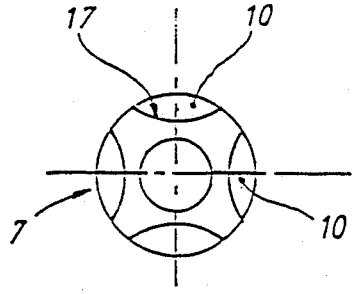
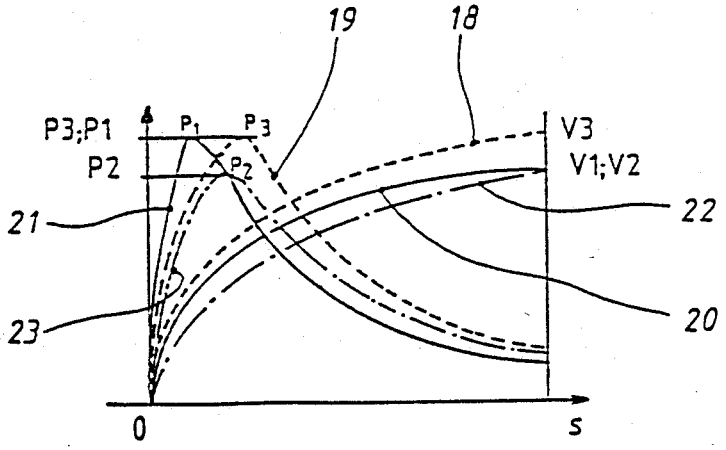
Fig 2

FIG. 3
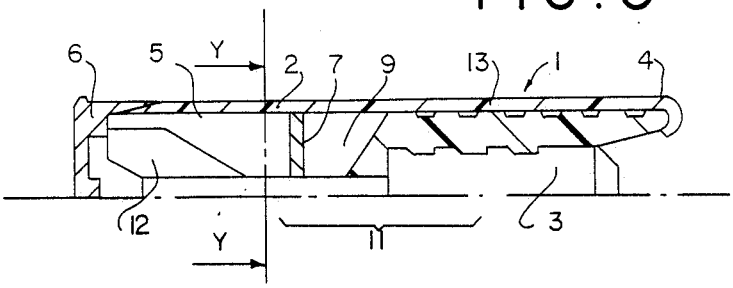
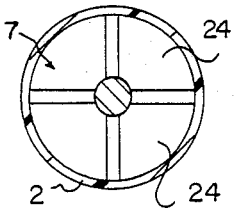
FIG. 4
FIG. 5B
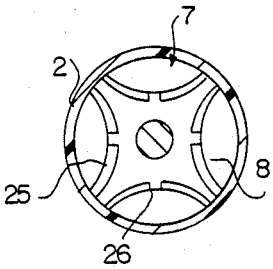
FIG. 5A
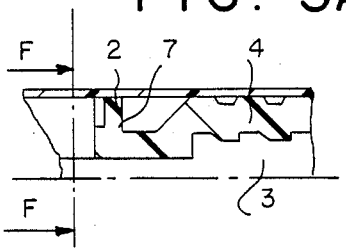
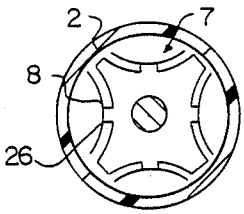
FIG. 5D
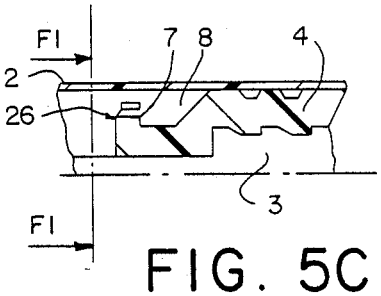
FIG. 5C

HUNTING AMMUNITION WITH INCREASED COMBUSTION VOLUME

This is a continuation, of application Ser. No. 055,901, filed 5/29/87, now abandoned.

BACKGROUND OF THE INVENTION

The present invention relates to ammunitions for small or medium calibre firearms and in particular to ammunitions for hunting firearms or weapons.

The French patent No. 83.18988 discloses an ammunition comprising an undergauged projectile stabilized by a feathering or tail fins which is actuated by the firing of a charge of propellant powder contained in a case; the pressure of the gas resulting from such a firing acts upon the rear portion of the sabot. This type of action is similar to that encountered with hunting cartridges fitted with conventional bullets and the major drawback is that the expansion ratio c/c' (c being the total volume of the bore, the case being inserted into the barrel or tube and c' being the volume assigned to the powder, the cartridge being in its operation position) is very large and may even exceed 40 for certain loadings. Now, an expansion ratio of too great value has a consequence an initial non-optimum velocity.

SUMMARY OF THE INVENTION

The object of the present invention is to provide a device allowing to obtain the highest possible initial velocity for a given powder.

The present invention also allows to significantly reduce the violence of the kick felt by the shooter; the device also allowing to facilitate the loading in of the cartridge as well as its assembly.

The invention relates therefore to an ammunition for a small or medium calibre firearm and in particular for a hunting firearm of the kind comprising a projectile consisting of an subcaliber bullet and a sabot having the firearm calibre, the projectile being actuated by the burning of a propellant charge contained in a case, which ammunition is characterized in that it comprises in the vicinity of the propellant charge an annular chamber separated from the propellant charge by a partition wall comprising one or several frangible areas which may be broken upon firing to provide for the expansion of the combustion gases in the chamber.

According to another main characterizing feature, the partition wall is integral with the projectile.

According to another characterizing feature, the partition wall is integral with the sabot.

According to a particular embodiment, each frangible area consists of one or several zones of reduced thickness of the partition wall. According to a preferred embodiment, the zones of reduced thickness consist of an even number of lunules regularly spaced from one another and located on the periphery of the partition wall.

According to another embodiment, the zones of reduced thickness consist of one or several grooves extending from the periphery of the partition wall.

According to one detail, the sabot exhibits a profile co-operating with one portion of the bullet so as to constitute one or several baffles stopping the advancing motion of the combustion gases of the propellant charge.

According to a secondary characterizing feature, the sabot comprises decompression or pressure relief grooves on its outer surface.

Preferably, the sabot is made solid with the case through the agency of the co-opertion of the latter with the decompression or pressure relief grooves of the sabot.

BRIEF DESCRIPTION OF THE DRAWINGS

For a fuller understanding of the invention, reference is made to the following description taken in conjunction with the accompanying drawings, in which;

FIG. 1 is a view on half section of an ammunition according to the present invention;

FIG. 1A is a view seen in the direction X of FIG. 1;

FIG. 2 shows a family of curves illustrating the evolution of the pressure of the propellant gases as well as of the velocity of the projectile versus the position of the projectile within the tubular barrel of the firearm;

FIG. 3 is a half-sectional view of another embodiment of an ammunition according to the invention;

FIG. 4 is a view seen in the direction Y of FIG. 3;

FIG. 5A is a partial sectional view of another embodiment of the invention shown prior to the firing of the propellant charge;

FIG. 5B is a view seen in the direction F of FIG. 5A;

FIG. 5C is a partial sectional view of the ammunition after firing;

FIG. 5D shows a view seen in the direction F1 of FIG. 5C;

DETAILED DESCRIPTION OF THE PREFERRED EMBODIMENTS

Figure 6:
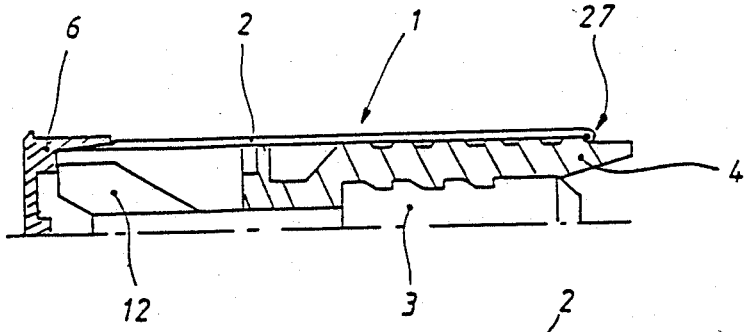
FIG. 6 is a part-sectional view of another embodiment of the crimping of the case.

FIG. 1 shows in section and in half view an ammunition 1 consisting of a case 2 of plastics material, cardboard or burnable material secured in a known way (as by adhesive bonding, gluing or sticking for instance) to a base 6; the base 6 carries a primer not shown. The case 1 contains a projectile 11 consisting of a bullet 3 (carrying a feathering 12) and of a sabot 4.

Between the sabot 4 and the base 6 is a chamber 5 filled with a propellant charge not shown.

The sabot made for instance from nylon or from any other type of plastics material whether containing fillers or not (which has the advantage of limiting the kick force) consists in a known manner of two halves intended to be separated or to part at the outlet or nozzle of the firearm under the effect of the air pressure acting upon the forward portion of the sabot to release the bullet.

The sabot 4 comprises on its outer surface a certain number of annular grooves 13 called decompression or pressure relief grooves the main function of which will be explained hereinafter. These annular grooves also allow to rigidly connect the sabot with the case 2 through hot crimping. By locally heating the case at the grooves of the sabot, the case is deformed and caused to conform to the shapes of the grooves thereby making the desired connection.

On its inner surface, the sabot comprises other grooves 15 which co-operate with teeth 14 formed on the bullet 3 so as to rigidly connect the latter to the sabot.

The sabot also comprises, backwards of the ammunition and in engagement with the propellant charge for the surface 16, called a guide-plate, a cylindrical portion which constitutes a partition wall 7 which separates the propellant charge from an annular chamber 9. This partition wall comes into engagement with the bullet 3 and with the inside of the case 2.

The thickness of the partition wall 7 is not constant; zones of less thickness having the shapes of lunules 10 limited by curved edges 17 are provided on its periphery at the contact between the partition wall and the case (see FIG. 1A).

The operation of the device is the following:

The ammunition is placed into the chamber of a firearm, the propellant charge contained in the chamber 5 is fired by the percussion of the primer. The gas pressure generated by the combustion of said charge rises and is exerted upon the guide plate of the partition wall 7. When the pressure exceeds that necessary to the unsetting, the projectile may advance to move out of the case and penetrate into the foreseen cone forming the starting portio of the barrel of the firearm.

For that period, the developed pressure, upon being exerted onto the lunules 10 will result in the breakage at the curved edge 17 which is an area where the component material of the launcher is frangible or brittle in view of the variation in thickness; the breaking failure will be greater at the junction between the edge 17 and the outer cylindrical surface of the partition wall in contact with the case. The component material of the lunules will remain or be left on the partition wall 7. This breakage upon providing the communication of the chamber 5 with the chamber 9, will allow an expansion of the gases; this expansion would regulate the combustion condition of the propellant charge while reducing the shock or kick felt by the shooter. Moreover, the mass of the propellant charge will thus have an increased available volume which will have, as a consequence, a decrease in the expansion ratio c/c' (c being the total volume of the bore, the case having been inserted into the barrel, c' being the volume assigned to the powder, the cartridge being in operating position).

With hunting cartridge having a conventional bullet, the expansion ration is of the order of 40; in the example described hereinabove, the expansion ratio is of the order of 25. FIG. 2 illustrates a family of curves giving the pressure P of the combustion gases and the velocity V of the projectile versus the position S of the projectile within the barrel of the firearm. The curve 21 gives the pressure and the curve 20 gives the velocity in the case of a conventional cartridge: P1=65 MPa, V1=420 m/s. When using a powder having a slower combustion speed with an ammunition according to the invention, the curves 23 for the pressure and 22 for the velocity are obtained thereby showing that there is an identical projectile velocity at the outlet of the firearm for a lower developed maximum pressure. It is thus possible to decrease the pressure P1 by 5 to 15 MPa without changing the velocity V1. Moreover, it is possible to optimize the ballistics of the ammunition and it is noted (curve 19 for the pressure and 18 for the velocity) that, with an equal maximum pressure, it is possible to increase owing to the system according to the invention, the outlet velocity V3 of the projectile and this 10 to 40 m/s. This is thus an approach to the so-called ideal powder by optimizing its combustion speed.

FIG. 3 shows another embodiment of the invention wherein the partition wall 7 is no longer connected with the sabot 4 but is connected to the bullet 3 and exhibits zones of reduced thickness 24 at which the pressure of the combustion gases of the propellant charge will cause breakings. The operation is similar to that previously described.

FIGS. 5A, 5B, 5C, 5D show another embodiment of the invention wherein the partition wall 7 is frangible or has become brittle owing to grooves 25 surrounding surfaces 8 having the shape of lunules similar to those already described previously.

The failure or breakage will take place along these grooves, the pressure of the gases causing the surfaces 8 to slightly tilt about the tongues 26 as diagrammatically shown on FIG. 5C.

FIG. 6 shows a projectile on which has been carried out another form of crimping than that depicted on FIG. 1. The case is wound at the forward end of the sabot 4 and forms a rim 27. The projectile bears through the medium of the feathering 12 upon the base 6.

Figure 7:
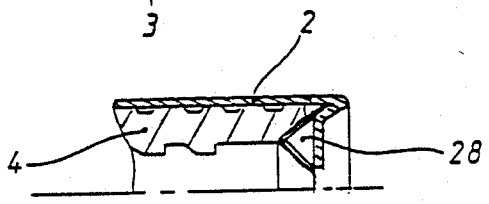
FIG. 7 is a partial sectional view of another embodiment of the crimping of the case.

FIG. 7 shows another form of crimping wherein the case 2 comprises at its forward portion a certain number of tongues 28 made during crimping and which are folded back onto the forward portion of the sabot 4 in order to hold the latter against motion (so-called "star-like" crimping).

Figure 8:
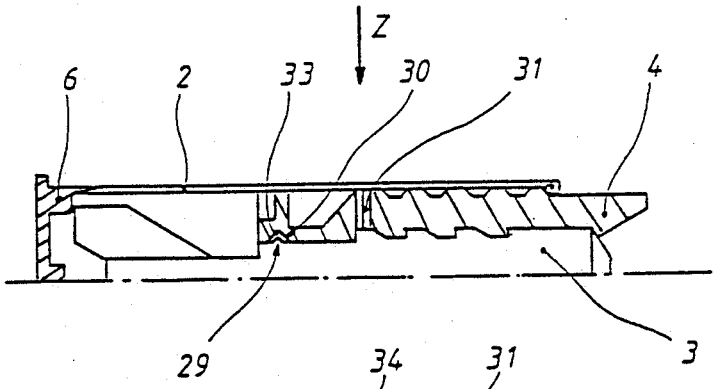
FIG. 8 shows another half-sectional view of the ammunition according to the invention illustrating details thereof.

The behaviour of the ammunition upon the firing of the propellant charge has been previousy described. For a proper operation, it is necessary that various members impervious to the combustion gases, be provided. Referring to FIG. 8, it is seen that the sabot 4 comprises at its rear portion an annular groove of triangular cross-section 30. This groove is in confronting relation to an annular profile of triangular cross-section 29 carried by the bullet 3. The juxtaposition of both profiles provides an annular void 33 which plays the part of a baffle hence of a decompression or pressure relief chamber for the propellant gases which would manage to flow between the bullet and the sabot. The decompression of these gases would stop their motion towards the front of the projectile.

Figure 8A:
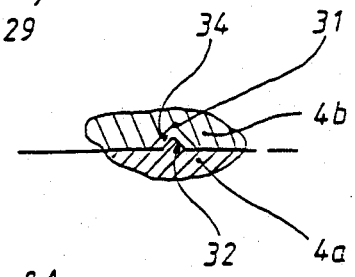
FIG. 8A is a partial view seen in the direction Z of FIG. 8.

To prevent the gas leaks which may occur between the two halves **4*a* and 4*b* of the sabot, another baffle consisting of a void space 34 located between both profiles 32 and 31 carried by the half 4*a* and the half 4*b*, respectively, of the sabot 4, is provided (see FIG. 8A). The operation of these decompression chambers is similar to that of the decompression grooves 13** carried by the outer surface of the sabot and which, by preventing the advancing motion of the combustion gases towards the front of the projectile between the tube of the barrel and the sabot, allow to provide for the fluid-tightness between these two elements hence for good inner ballistics of the ammunition.

Other alternative embodiments are possible within the scope of the invention.

It is in particular possible to provide a sabot comprising more than two separable portions or an integral sabot having lines of breaking allowing its parting under the combined effect of the air acting at its front portion and of the propellant gases acting at its rear portion.

The invention described hereinabove as applied to a projectile stabilized by a feathering, may also be adapted to any other type of small or medium calibre ammunition and hunting ammunitions.

What is claimed is:

1. Ammunition for a small or medium calibre firearm, including a case secured to a base carrying a primer;

a projectile contained in the case and constituted by a subcalibre bullet and sabot having the calibre of the firearm;

a chamber disposed between the sabot and the base and filled with a propellant charge for propelling the projectile when the propellant charge is fired;

the ammunition further comprising an annular chamber free of propellant charge positioned forwardly of the chamber filled with the propellant charge and separated from the latter by a partition wall in engagement with an inside of the case, said partition wall having at least one frangible area which is broken upon firing to provide for an expansion of combustion gases into the annular chamber, said frangible area being located at an outer cylindrical surface of said partition wall in contact with said case.

2. Ammunition according to claim 1, wherein each frangible area of the partition wall consists of a zone of reduced thickness of the partition wall.

3. Ammunition according to claim 1, wherein the sabot comprises decompression angular grooves on an outer surface thereof.

4. Ammunition according to claim 3, wherein the sabot is rigidly connected to the case through the angular grooves.

5. Ammunition according to claim 1, where the partition wall is additionally in engagement with the subcaliber bullet.

6. Ammunition according to claim 1, wherein the partition wall is solid with the projectile.

7. Ammunition according to claim 2, wherein the zones of reduced thickness consist of one or several grooves extending from the partition wall.

8. Ammunition according to claim 1, wherein the sabot has a profile co-operating with a portion of the bullet so as to constitute one or several baffles stopping the advancing motion of the combustion gases of the propellant charge.

9. Ammunition according to claim 1, wherein the sabot is made in two halves co-operating with one another so as to constitute one or several baffles stopping the advancing flow of the combustion gases of the propellant charge.

10. Ammunition for a small or medium caliber firearm, including a case secure to a base carrying a primer;

a projectile contained in the case and constituted by a subcaliber bullet and a sabot having the caliber of the firearm;

a chamber disposed between the sabot and the base and filled with a propellant charge for propelling the projectile when the propellant charge is fired;

the ammunition further comprising:

an annular chamber free of propellant charge and separated from the chamber filled with the propellant charge by a partition wall in engagement with an inside of the case and integral with the sabot.

said partition wall having at least one frangible area which is broken upon firing to provide an expansion of combustion gases into the annular chamber, wherein each frangible area of the partition wall consists of a zone of reduced thickness of the partition wall, and comprises an even number of zones or reduced thickness having shape of lunules located on a rear surface on the partition wall adjacent to the chamber filled with propellant charge and regularly spaced from each other on a periphery of the partition.

* * * * *